US005450800A

United States Patent [19]

Leonard

[11] Patent Number: 5,450,800

[45] Date of Patent: Sep. 19, 1995

[54] ERGONOMICALLY ADJUSTABLE COMPUTER WORKSTATION

[76] Inventor: Joseph W. Leonard, 49 Summit Dr., Huntington, N.Y. 11743

[21] Appl. No.: 213,608

[22] Filed: Mar. 15, 1994

[51] Int. Cl.[6] ..... A47F 5/12

[52] U.S. Cl. ..... 108/7; 312/319.8; 312/223.3; 74/89.14; 74/89.17; 74/89.22

[58] Field of Search ..... 108/7, 10, 1, 50, 147; 312/7.2, 29, 319.8, 223.3; 74/89.14, 89.17, 89.22; 318/9, 10, 11, 12, 14, 15

[56] References Cited

U.S. PATENT DOCUMENTS

| | | | |
|---|---|---|---|
| 2,646,322 | 7/1953 | Laxo | 108/7 X |
| 2,931,685 | 4/1960 | Butler | 312/196 |
| 2,987,937 | 6/1961 | Sala | 74/89.14 X |
| 3,140,559 | 7/1964 | Grow et al. | 108/10 X |
| 3,478,654 | 11/1969 | Willard | 108/50 X |
| 4,750,402 | 6/1988 | Markey | 108/90 X |
| 5,041,770 | 8/1991 | Seiler et al. | 108/7 X |
| 5,044,284 | 9/1991 | Gross | 108/10 |
| 5,273,352 | 12/1993 | Saper | 312/7.2 |
| 5,313,892 | 5/1994 | Tice | 108/7 X |
| 5,340,111 | 8/1994 | Froelich | 108/7 X |

FOREIGN PATENT DOCUMENTS

| | | | |
|---|---|---|---|
| 2490085 | 3/1982 | France | 108/147 |
| 676416 | 1/1991 | Switzerland | 108/1 |

*Primary Examiner*—Laurie K. Cranmer
*Assistant Examiner*—Janet M. Wilkens
*Attorney, Agent, or Firm*—Bauer & Schaffer

[57] ABSTRACT

An ergonomically adjustable computer workstation comprises a fixed base assembly, and a movable frame assembly slidably mounted to the fixed base assembly. The movable frame assembly includes a support member and platform supporting a video display terminal thereon. The workstation also includes a mechanism, mounted to the base assembly, for adjusting the height of the movable frame assembly and a mechanism, mounted to the frame assembly, for adjusting the rotational orientation of the platform.

8 Claims, 6 Drawing Sheets

ERGONOMICALLY ADJUSTABLE COMPUTER WORKSTATION

FIELD OF THE INVENTION

The present invention relates to an improved computer workstation and in particular, to an ergonomically adjustable computer workstation which is capable of providing variable vertical and rotational orientation of a computer monitor or a video display terminal wherein such adjustment may be effected while the operator is seated in working position, so as to alleviate operator injury and to enhance productivity.

BACKGROUND OF THE INVENTION

Workstations for computer equipment are well known. Known computer workstations generally comprise a plurality of distinct, fixedly mounted horizontal surfaces for supporting a computer monitor or VDT (Video Display Terminal), a computer keyboard, a central processing unit and a computer printer. In one configuration, the keyboard is positioned in front of and at a lower horizontal plane than the VDT, which sits behind and elevated from the keyboard. Using such a workstation, the location of the VDT forces the operator to strain his or her neck in order to view the VDT. In addition to the annoyance of neck strain and the associated decrease in productivity, prolonged neck strain may result in long-term illness, increased absenteeism and higher health insurance premiums.

Attempts have been made to alleviate this problem. For example, U.S. Pat. Nos. 4,755,009 and 5,071,204 to Price et al., 4,869,564 to Lechman and 4,590,866 to Schairbaum disclose computer workstations wherein the VDT is mounted below a transparent portion of an modified desktop surface at a lower horizontal plane than the keyboard, which is positioned atop the surface. In U.S. Pat. No. 4,590,866 to Schairbaum, the VDT is mounted on movable supports below an enlarged transparent work surface and may be moved forward and backward, rotatably and side-to-side, the combination of such movements providing a wide variety of convenient locations for the VDT.

Variations of the aforementioned workstations exist, such as those having vertically adjustable flat surfaces for positioning of a keyboard and VDT which surfaces may, for example, be periodically varied by the operator in order to relieve back strain.

Even in view of the numerous commercially available workstations, the problem of neck strain remains of primary concern and the decreased productivity, increased incidence of VDT related ailment coupled with increased health benefit premiums reflect the need for a computer workstation that alleviates these problems.

In a recent survey of 10,000 telecommunications workers whose duties include the intensive use of computers, the Occupational Safety and Health Office of the Communications Workers of America (CWA) concluded that eighty-six percent of the respondents had experienced daily incidence of neck and shoulder pain, as well as numbness in their extremities.

Another recent survey of computer operators performed at the University of Idaho operated under the hypothesis that computer operators generally will readjust their postures rather than the configuration of their workstations. The results of this study indicate that the presumption of the researchers was correct. More importantly, the results indicate that depending upon the application, the computer operators surveyed tended to make severe posture adjustments rather than minor workstation adjustments. Nearly seventy percent of those surveyed had never adjusted their keyboards, eighty-eight percent had never adjusted the height or position of their VDT, eighty-three percent had never adjusted their chair, and ninety percent had never adjusted their table, despite the relative ease of effecting such adjustments. Further, this study indicated that the vast majority of individuals who reported the most common computer related ailments which occur on a daily basis, i.e., neck aches, eye strain and headaches, were invariably among those operators who had never adjusted their workstation environments, choosing rather to manipulate their posture to fit the application. It is this severe posture manipulation which causes the vast majority of VDT related ailments. These results strongly suggest that ergonomically adjustable work station components are not fully utilized by the vast majority of VDT operators, indicating that the workstations are not convenient to adjust.

The results of this study demonstrate that existing ergonomically adjustable computer workstations do not provide convenient adjustment, resulting in the neglect of their benefits by computer operators. For instance, some adjustable workstations require inconvenient mechanical adjustments, necessitating the use of tools for their adjustment. Although permitting adjustment quite easily, others are not capable of being adjusted while the computer operator is seated in a working position. Consequently, the operator is at a loss to arbitrarily determine the optimum workstation configuration and does not adjust the workstation, suffering from neck strain as a result.

Thus, there is a need for a computer workstation capable of effecting a wide range of adjustments in the vertical and rotational orientation of the VDT which adjustments may easily and conveniently be effected while the computer operator is seated in a comfortable and typical work position.

In order to design a computer workstation that solves these problems, the present inventor has undertaken to study VDT related ailments. During this exhaustive investigation, the present inventor correlated the nature and cause of certain VDT related ailments and invented an optimal computer workstation to prevent the occurrence of such ailments.

SUMMARY OF THE INVENTION

In view of the aforementioned shortcomings, it is an object of the present invention to provide an ergonomically adjustable computer workstation that permits a wide variety of adjustments which are simple and convenient to effect.

It is another object of the present invention to provide an ergonomically adjustable computer workstation that permits a continuous range of variation in the vertical and rotational orientation of a VDT, which variation may be effected with a minimum of operator effort. Most importantly, it is an object of the present invention to provide a workstation which effects such adjustment while the operator is in a seated comfortable work position so as to enable the computer operator to determine the optimal position for a particular application and to vary the workstation configuration as often as needed in order to relieve the physical stress associated with prolonged and intensive computer use.

In one aspect of the present invention, an ergonomically adjustable computer workstation is provided. The workstation comprises a fixed base assembly, a movable frame assembly slidably mounted to the fixed base assembly and having a video display terminal thereon. The movable frame assembly comprises a platform and a support member. The workstation also comprises means for adjusting the height of the movable frame assembly and means, mounted to the frame assembly for adjusting the rotational orientation of the platform.

In a preferred embodiment, the means for adjusting the height comprises a motor for exerting a rotational force, linkage means and pulley means attached to the base member for converting the rotational force into a linear force, and for transmitting the linear force to the movable frame assembly. In the preferred embodiment, the means for adjusting the rotational orientation comprises a first pivot bracket fixedly attached to the frame assembly at the support member thereof; a second pivot bracket fixedly attached to the platform; a gas cylinder means for exerting a holding force and a driving force in the upward direction, wherein the gas cylinder means comprises a cylinder section and a piston section, having one of the sections fixedly attached at the frame support member to the first pivot bracket and the other of the sections fixedly attached at the platform to the second pivot bracket; and compressor means for selectively providing pressurized gas to the gas cylinder means in order to create the holding and driving force.

BRIEF DESCRIPTION OF THE DRAWINGS

The foregoing summary, as well as the following detailed description of a preferred embodiment of the invention, will be better understood when read in conjunction with the appended drawing. For the purpose of illustrating the invention, there is shown an embodiment which is presently preferred. It being understood, however, that this invention is not limited to the precise arrangements and instrumentalities shown. In the drawings.

DETAILED DESCRIPTION OF THE PREFERRED EMBODIMENTS

The present invention is directed to a computer workstation that provides variable vertical and rotational orientation of a VDT. Thus, it is to be understood that the computer workstation contemplated by the present invention may ultimately be retrofit in a conventional office desk or the like. Alternatively, the workstation may be utilized in a dedicated article of furniture, intended only to house computer peripheral equipment. The description of the workstation will therefore concentrate on the particular elements and components which are distinct to the improvements of the present invention, keeping in mind that the disclosed embodiment is to be used as part of a greater overall structure, as described above. Thus, the details of the conventional office desk or article of furniture are not pertinent to the present invention and are well understood by those skilled in the art. Accordingly, further description thereof is omitted for purposes of convenience only and is not limiting.

Figure 1:
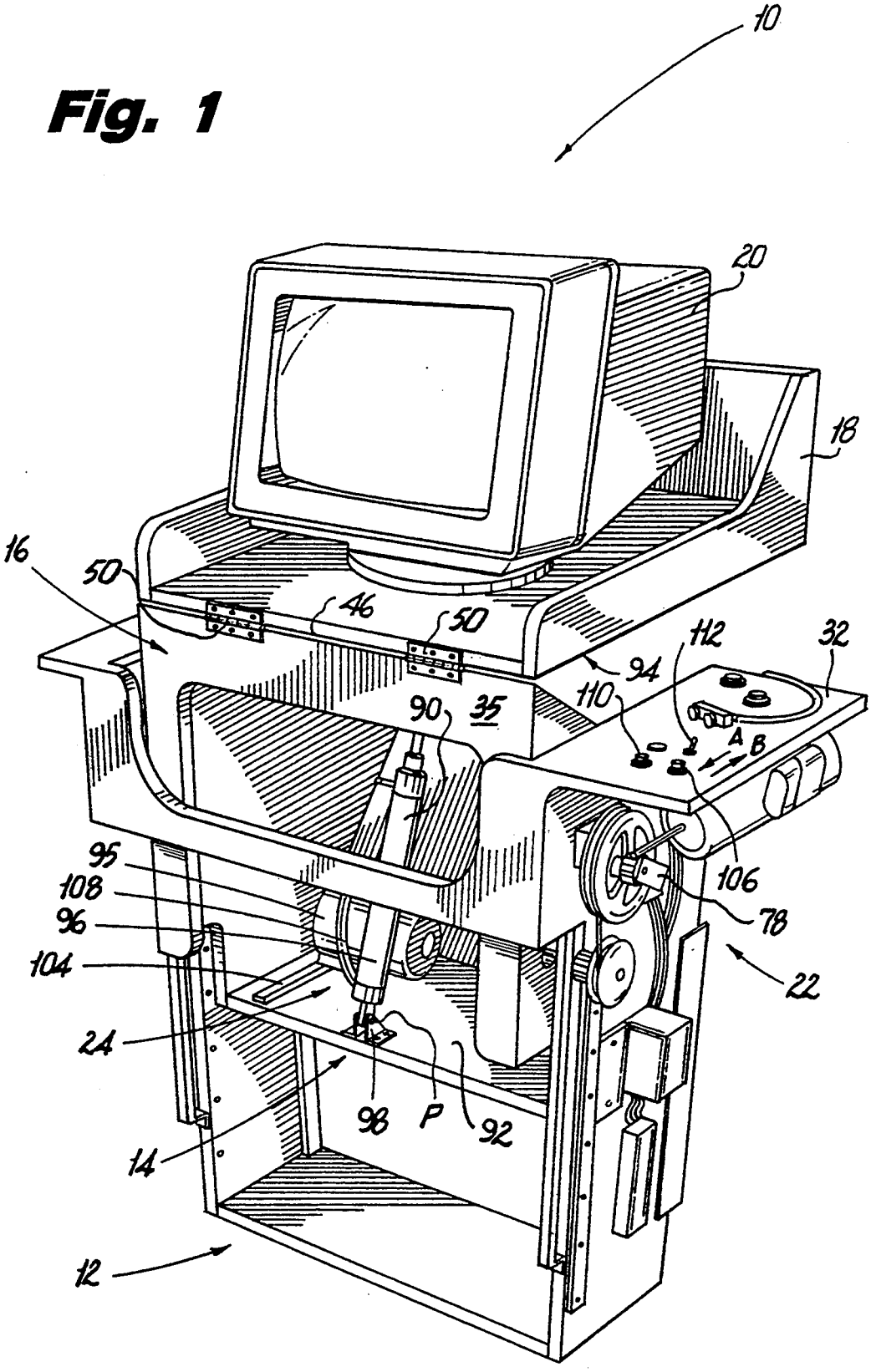
FIG. 1 is a front perspective view of an adjustable computer workstation in accordance with the teachings of the present invention.

Referring now to the drawings in detail, wherein like numerals indicate like elements throughout, there is shown in FIGS. 1–7 a preferred embodiment of an ergonomically adjustable computer work station, generally designated 10, in accordance with the present invention. As shown in FIG. 1, the computer workstation 10 comprises a fixed base member or box-like housing assembly, generally designated 12, and a movable box-like frame assembly, generally designated 14, slidably mounted to the fixed base member. The movable frame assembly 14 comprises a support member 16 and a platform 18 upon which a computer monitor or a video display terminal (VDT) 20 is placed or fixedly mounted. The workstation also comprises means, generally designated 22, mounted to the base member 14 for adjusting the height of the movable frame assembly and means, generally designated 24, mounted to the frame assembly for adjusting the rotational orientation of the platform 18.

Figure 2:
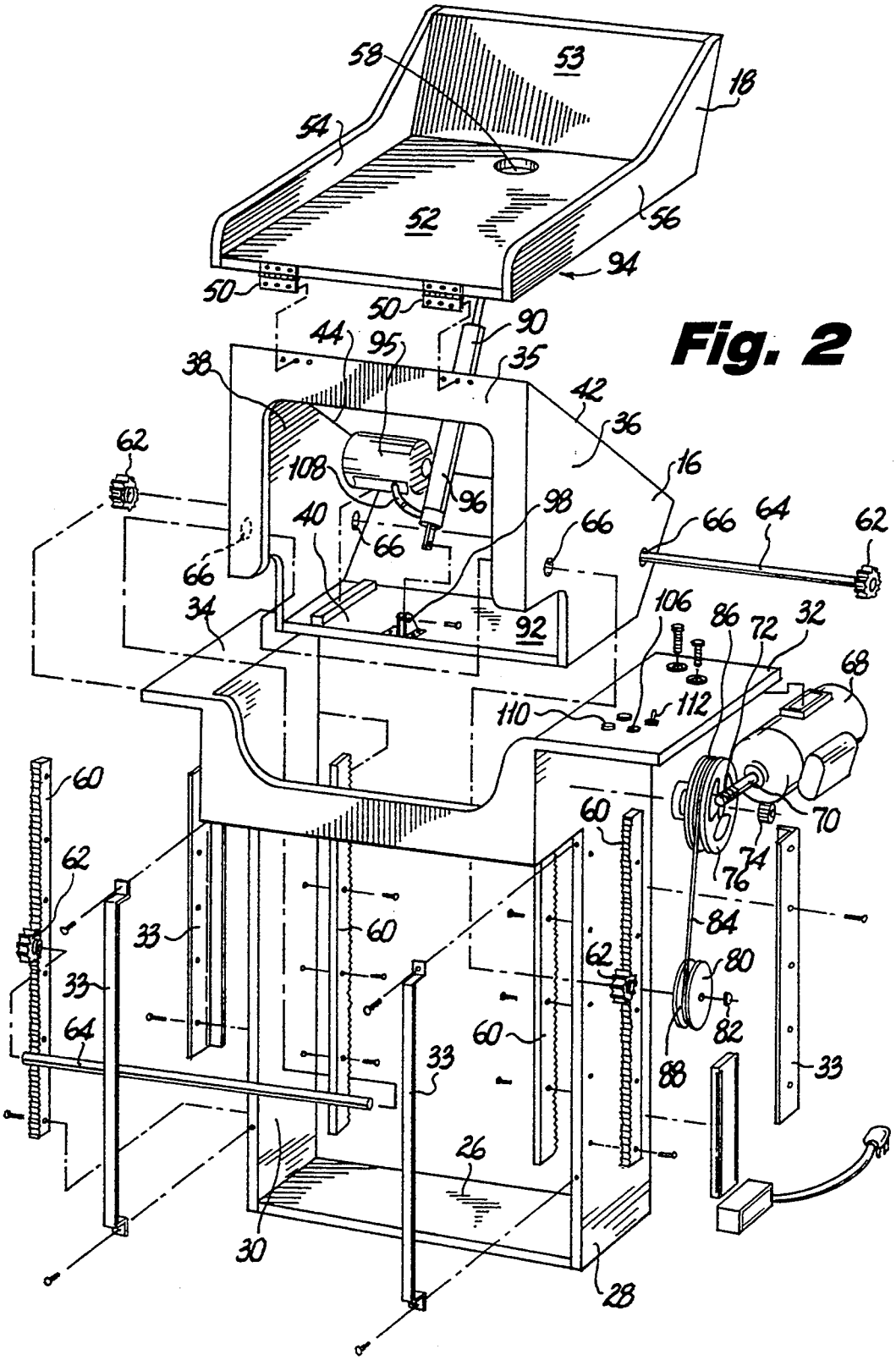
FIG. 2 is a partially exploded perspective view of the computer workstation of FIG. 1.

As best shown in FIGS. 1 and 2, the base assembly 12 comprises a base 26 and sidewalls 28, 30 defining an enclosure within which the support member 16 of the frame assembly 14 is movably mounted for vertical movement therein. The sidewalls 28, 30 terminate at its upper ends with respective support surfaces 32, 34. The support surface 32 serves as a control panel for effecting vertical and rotational adjustment of the frame assembly 14 as further described above. Braces 33, preferably fabricated of a suitable metal material, are also provided for reinforcing the base assembly 12.

The support member 16 of the movable frame assembly 14 comprises a front wall 35, sidewalls 36, 38 and a bottom wall 40. The sidewalls 36, 38 define supporting surfaces 42, 44 sloping down from the proximal end 46 to the distal end 48 thereof to define an angle of inclination (see FIG. 3). Hence, the sidewalls 36, 38 are adapted to permit the VDT platform 18 to be pivotally connected thereto and to be disposed at an angle, sloping down from the proximal end 46 to the distal end. The VDT platform 18 is pivotally mounted by hinges 50, or the like, to the front wall 35. When the VDT platform 18 is flush against the sidewalls 36, 38 of the support member 16, a monitor mounted or placed on the platform will be disposed at the angle of inclination defined by sidewalls 36, 38.

The VDT platform 18 includes a support surface 52, a rear wall 53 for the VDT 20 and sidewalls 54, 56 which are adapted to form a retainer for the support surface such that a VDT may placed and retained thereon, regardless of the rotational orientation of the VDT platform. The rear wall 53 is made to provide a smooth, uniform background for the monitor, which is preferably of a color, reflective to light, so that the operator is not distracted by other office background activities.

A slot 58 is provided at the rear of the support surface 52 to allow access for VDT cabling (not shown). Furthermore, it is understood by those skilled in the art a grommet (not shown) may be used to protect the cabling from the abrasiveness of the material used in constructing the VDT platform 18. In order to prevent the VDT cable from becoming trapped between the moving parts of the work station 10, a cable track (not shown) well known by those skilled in the art may be conveniently provided to restrict any undesired movement of the cable while permitting adequate movement for proper operation of the work station.

Figure 3:
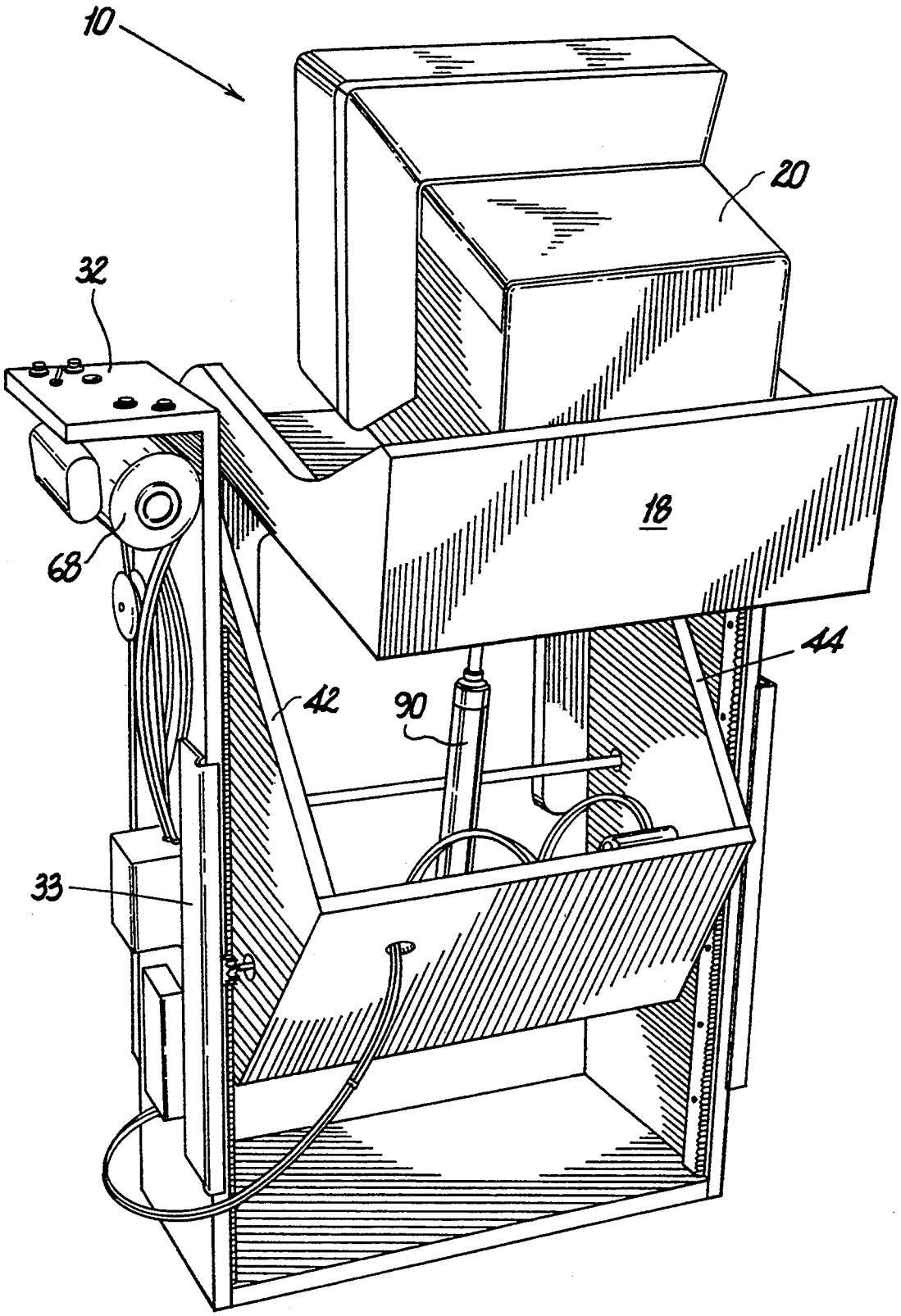
FIG. 3 is a rear perspective view of the computer workstation of FIG. 1.

As can be seen in FIGS. 1–3, the frame assembly 14 is seated within the base assembly 12, both having the same external shape, and is slidably mounted to the base assembly via a gear linkage including a set of four vertically oriented gear racks 60 mounted in pairs to the sidewalls 28, 30, respectively, symmetrically about the periphery of the base assembly. The gear racks 60 are mounted such that they comprise two pairs of laterally opposed racks. A pair of pinion gears 62, connected at the centers thereof by a solid shaft connecting rod 64, is provided for each pair of gear racks 60. Each of the rods 64 pass from a gear rack 60 on one side of the base assembly 12, through laterally opposing holes 66 formed in the sides 36, 38 of the frame support member 16, and finally to the opposing gear rack 60. This symmetrical structure ensures that the mass of the frame assembly 14 is evenly distributed about the pinion gears 62. Thus, when any of the pinion gears 62 is driven the set of four pinion gears simultaneously act to vertically move the frame assembly 14 and, hence, the VDT 20 supported on the platform 18. It is understood by those skilled in the art that the above-mentioned components may be mounted to the base assembly 12 by standard, off-the-shelf hardware without departing from the spirit and scope of the invention.

According to a preferred embodiment of the present invention, the means 22 for adjusting the height of the frame assembly 14 with respect to the base assembly 12 comprises a motor 68 mounted to the support surface 32 of the base assembly for exerting a rotational force and pulley means associated with the above-mentioned gear linkage for converting the rotational force into a linear force and for transmitting the linear force to the frame assembly 14.

More specifically, the motor 68, which could be a reversible, alternating current (AC) motor well known in the art, includes a rotating shaft 70 which rotates in accordance with operation of the motor. In order to convert this rotational force into vertical movement, a worm gear 72 and a worm wheel 74, are provided. As illustrated in FIGS. 1 and 2, the shaft 70 is provided with the worm gear 72 formed at its end. The worm gear 72 rotates in a like manner to the shaft 70, with its teeth causing the worm wheel 74 to rotate in an orthogonal direction with respect to the direction of rotation of the shaft 70.

As is also shown in FIGS. 1 and 2, the worm wheel 74 is attached to a first pulley 76 via an interconnecting shaft 78. A second pulley 80, which is vertically aligned with the first pulley 76, is attached to the pinion gear 62 directly below the first pulley. A cable 84, preferably fabricated from stainless steel, is attached to the track 86 of the first pulley 76 and is also attached to the track 88 of the second pulley 80.

Figure 5:
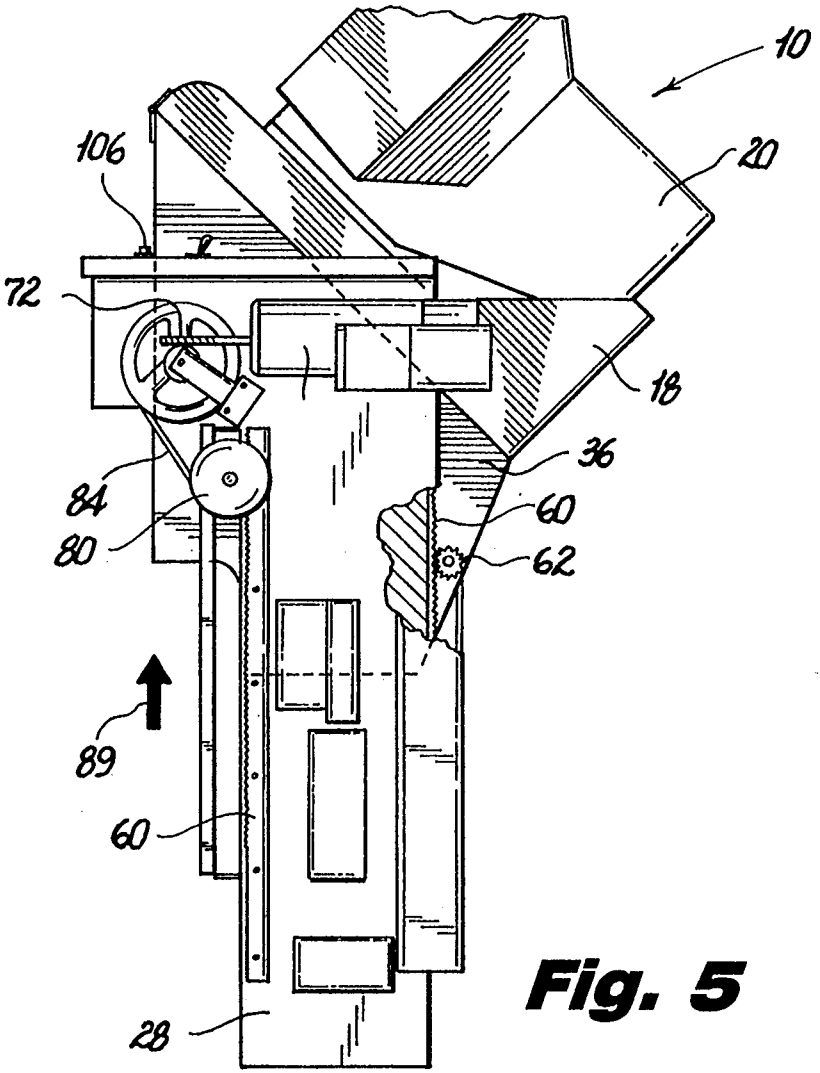
FIG. 5 is a partially sectioned side view of the computer workstation illustrating the VDT in a fully raised, or extended position.
Figure 4:
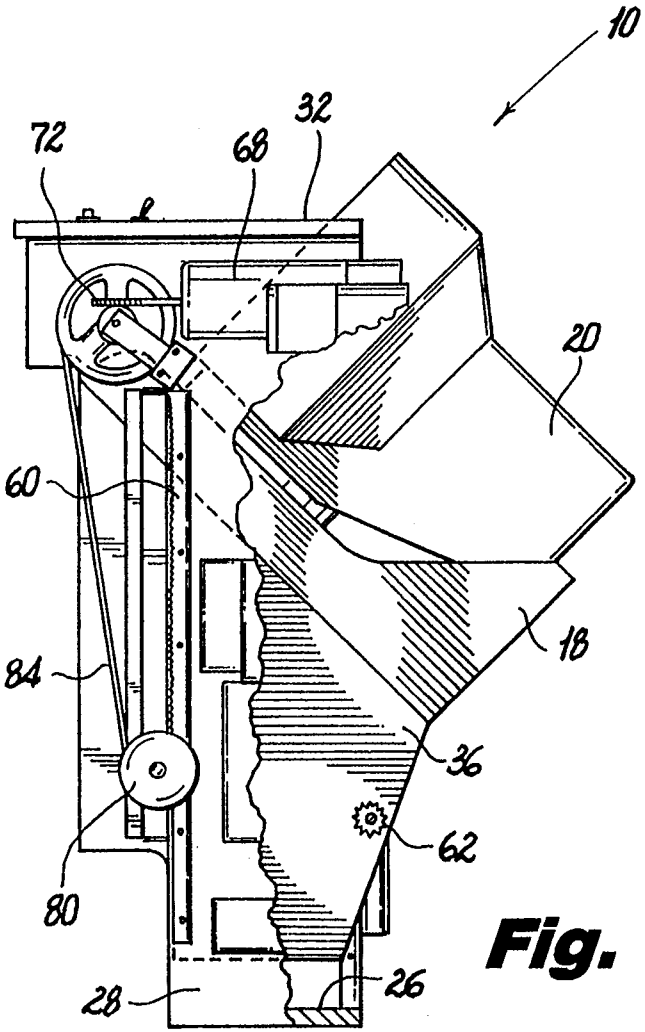
FIG. 4 is a partially cut-away side view of the computer workstation illustrating the VDT in a fully lowered position.

When the AC motor is activated, the shaft 70 spins causing the worm gear 72 to spin. The gear linkage between the worm gear and worm wheel forces the first pulley 76 to similarly rotate, thereby applying a rotational force to the second pulley 80 via the cable 84. This rotational force causes the second pulley 80 to rotate the pinion gears 62 simultaneously which in turn cause the frame assembly 14 to move vertically with respect to the base assembly 12. More specifically, operation of the motor 68 in the forward direction forces the cable 84 to pull the second pulley 80 and thereby raise the frame assembly 14. As the first pulley 76 rotates, the cable 84 becomes entrained in its track 86. Reverse operation of the motor 68 forces the first pulley 76 to rotate in a counterclockwise direction, releasing the cable 84 and lowering the frame assembly 14. In this operation, the cable 84 becomes entrained in the track 88 of the second pulley 80 and the frame assembly 14 descends vertically until the cable 84 has been fully extended. FIGS. 4 and 5 illustrate the support member 16 in a fully lowered position and fully raised or extended position, respectively. In FIG. 5, the arrow 89 indicates the direction of movement of the support member 16 from its lower position (FIG. 4) to its raised position.

It will be readily appreciated by those of ordinary skill in the art that the present embodiment utilizes four vertically oriented gear racks 60 which are symmetrically mounted about the base assembly 12. The four pinion gears 62, connected laterally in pairs by the solid connecting rods 64, support the frame assembly 14 within the base assembly 12 and force the frame assembly to rise or descend in accordance with movement of the pinion gears. The use of a symmetrical arrangement of gear racks 60 and pinion gears 62 provides stability. In operation, each corner of the frame assembly 14 is moved simultaneously, having identical forces applied thereto at all points of contact. Thus, vertical movement of the frame assembly 14 is accomplished in a smooth fashion, with no part of the frame becoming jammed. In addition, the great degree of mechanical strength of the pinion gears 62 and racks 60 ensures that the frame assembly 14 cannot lose alignment with the base assembly 12.

According to a preferred embodiment of the present invention shown in FIGS. 1–3, the means for adjusting the rotational orientation of the frame assembly 14 with respect to the base assembly 12 comprises an air cylinder 90 mounted at one end to the lower internal surface 92 of the support member 16 and at its other end to the external bottom surface 94 of the platform 18, and an air compressor 95. More specifically, the air cylinder 90 is provided with a long, extendable cylinder section or piston shaft 96 mounted at its lower end to the internal surface 92 of the support member 16 via a first pivot bracket 98 such that the air cylinder 90 is not rigidly mounted but may pivot about a point P move in one plane. The air cylinder 90 is also provided with a piston section or piston rod 100 similarly mounted to the bottom surface 94 of the platform 18 by a second pivot bracket 102 (FIGS. 6 and 7), such that the piston rod 100 can pivot about point P′ (FIGS. 6 and 7) in the same plane as the cylinder is permitted to pivot about the point P. It will be understood by those skilled in the art that, in the alternative, the end of the piston rod 100 could be mounted to the second pivot bracket 102 and the end of the piston shaft 96 could be mounted to the first pivot bracket 98 without departing from the spirit and scope of the invention.

The air compressor 95 is mounted to the support member 16 via standard hardware as recognized in the art. The air compressor 95 is preferably mounted to a bracket 104 which provides isolation between the air compressor and the support member 16. When mounted in this manner, the mechanical vibration of the air compressor 95 is absorbed by the bracket 104 and does not affect the workstation 10. It is understood by those skilled in the art that the compressor 95 should be selected such that it is capable of providing adequate air pressure to cause the air cylinder 90 to raise the weight of the platform 18 and VDT 20 thereon.

Preferably, the air cylinder 90 is any commercially available gas cylinder that is capable of providing adequate force to raise the VDT platform 20 may be used for this purpose. However, it is understood by those of ordinary skill in the art that other mechanisms are suitable for accomplishing this purpose. For example, a locking air spring operated mechanism, also capable of providing adequate lifting force and preferably having a remote, switch operated lock may be used. The air cylinder 90 provides the force necessary for rotational adjust of the VDT in a manner described below.

Figure 6:
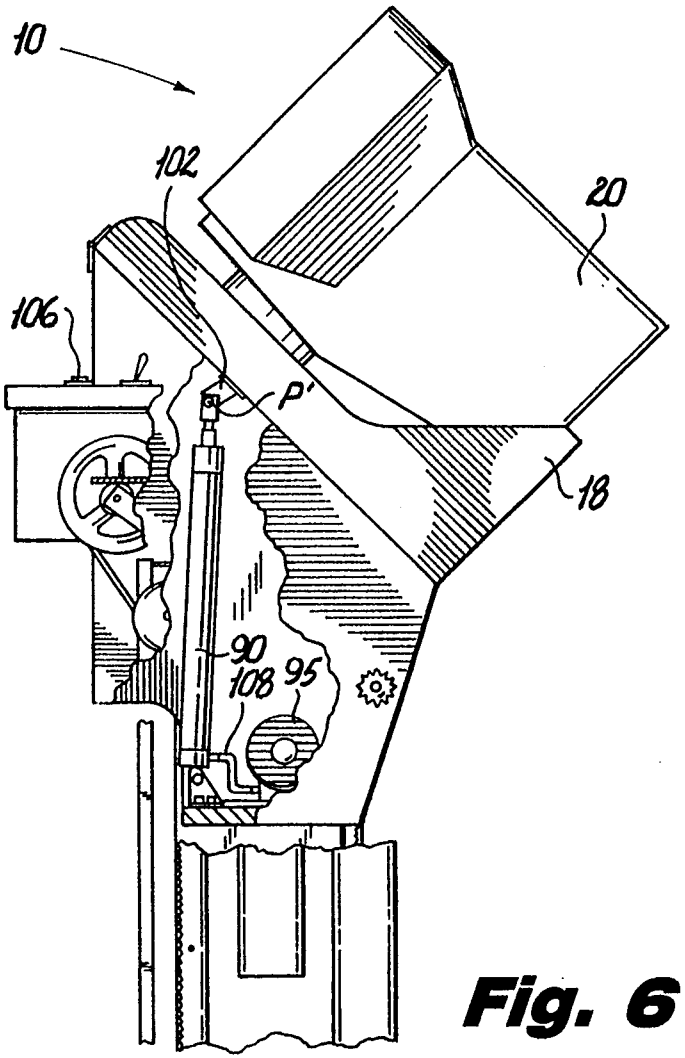
FIG. 6 is a partially sectioned side view of the computer workstation illustrating the VDT in a fully raised position having maximum tilt.

When an operator desires to alter the angle of the viewing screen on the VDT 20, it is important that the mechanism for effecting this adjustment is convenient and effortless. Initially, as shown in FIG. 6, the platform 18 is disposed at an angle of inclination defined by the supporting surfaces 42, 44 of the support member 16. This is also the maximum angle of inclination or tilt achievable by the platform 18. The angle of inclination of the platform 18, and thus the VDT 20, is varied by controlling a first pushbutton 106 located on the operator control panel situated on the support surface 32 of the support member 16. It will be appreciated that this angle may be so easily modified via the first pushbutton 106 which is easily accessible by the operator.

Figure 7:
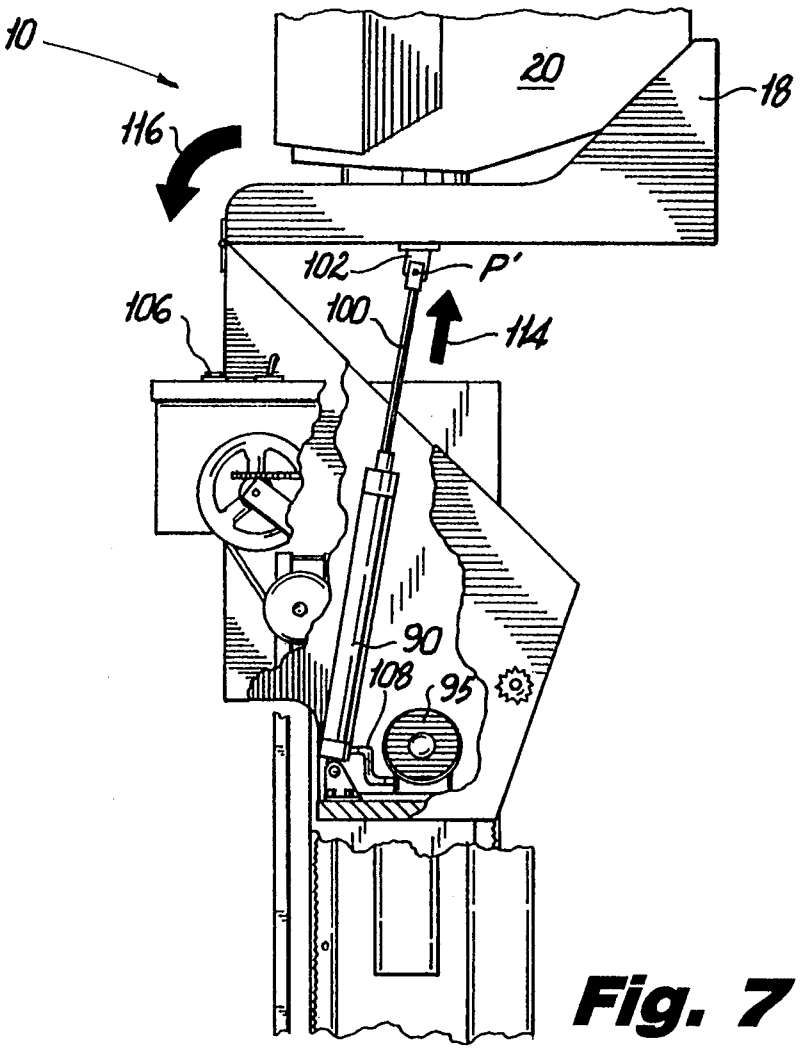
FIG. 7 is a partially sectioned view of the computer workstation illustrating the VDT in a fully raised position with no tilt.

As shown in FIG. 7, when the first pushbutton 106 is depressed, the air compressor 95 is actuated, forcing compressed air into the air cylinder 90 via an interconnecting air hose 108. As the internal chamber of the air cylinder 90 becomes pressurized, the piston rod 100 extends further out of the air cylinder, in the direction indicated by arrow 114 causing the platform 18 to rise, and pivot about its interconnecting hinges 50, in the direction indicated by arrow 116, thereby decreasing the angle of tilt. When the desired angle of tilt is reached, the first pushbutton 106 is released, thereby deactivating the air compressor 95 and maintaining the air cylinder 90 in its current state. When the operator desires to decrease the angle of tilt, a second pushbutton 110 is depressed, unlocking the air cylinder 90 and slowly releasing air from the cylinder until the second pushbutton 110 is released.

It will be understood by those skilled in the art that the angle of inclination defined by the sidewalls 36, 38 of the support member 16 should chosen so as to be adequate to ensure viewability of the VDT at each of the positions selected by operation of the air cylinder 90 as described above. Preferably, the angle of incline is chosen such that when the frame assembly is at its lowest vertical position, the operator need not readjust the rotational orientation of the VDT in order to view the screen.

Similarly, the reversible AC motor 68 is also controlled by a switch 112 mounted on the control panel at the support surface 32 of the support member 16 which can be operated from the seated or standing position. Pushing the switch 112 in the forward direction, indicated by arrow A in FIG. 1, activates the AC motor 68, thus allowing the frame assembly 14 and thus the VDT platform 18 to be raised. Pushing the switch 112 in the rearward direction, indicated by arrow B in FIG. 1, causes a reverse polarity alternating current input to the AC motor 68 to lower the frame assembly 14 and thus the VDT platform 18. When the desired height is reached, the switch 112 is released, thereby removing the input from the AC motor 68 and locking the frame assembly 14 in the desired vertical position until the switch is again activated by the operator.

As it will be readily appreciated by those of ordinary skill in the art, the computer workstation 10 is designed such that it provides the operator with easily manipulatable vertical and rotational orientation of a monitor or VDT terminal 20. For instance, the VDT may be positioned below a flat work surface, having its screen angled towards the operator's field of view. While remaining seated in a comfortable work position, the operator may then easily move the VDT to a position substantially above the work surface and simultaneously change its angle of tilt.

The base assembly 12 and the frame assembly 14, including the VDT platform 18, may be constructed in accordance with any known furniture building techniques using any rigid construction material such as particle board, plywood, or hardwood. However it is understood by those of ordinary skill in the art that other materials are suitable. For example, these assemblies may be constructed of metal or of a composite or polymer material.

As discussed above, the workstation 10 of the present invention is designed for simple installation in a desk or similar piece of furniture which has been adapted to accommodate the workstation. However, it will be appreciated by those skilled in the art that the workstation 10 need not be installed as a modification of another piece of furniture in order to be operative, but may be constituted as a self-contained, standalone workstation as further described below.

Figure 8:
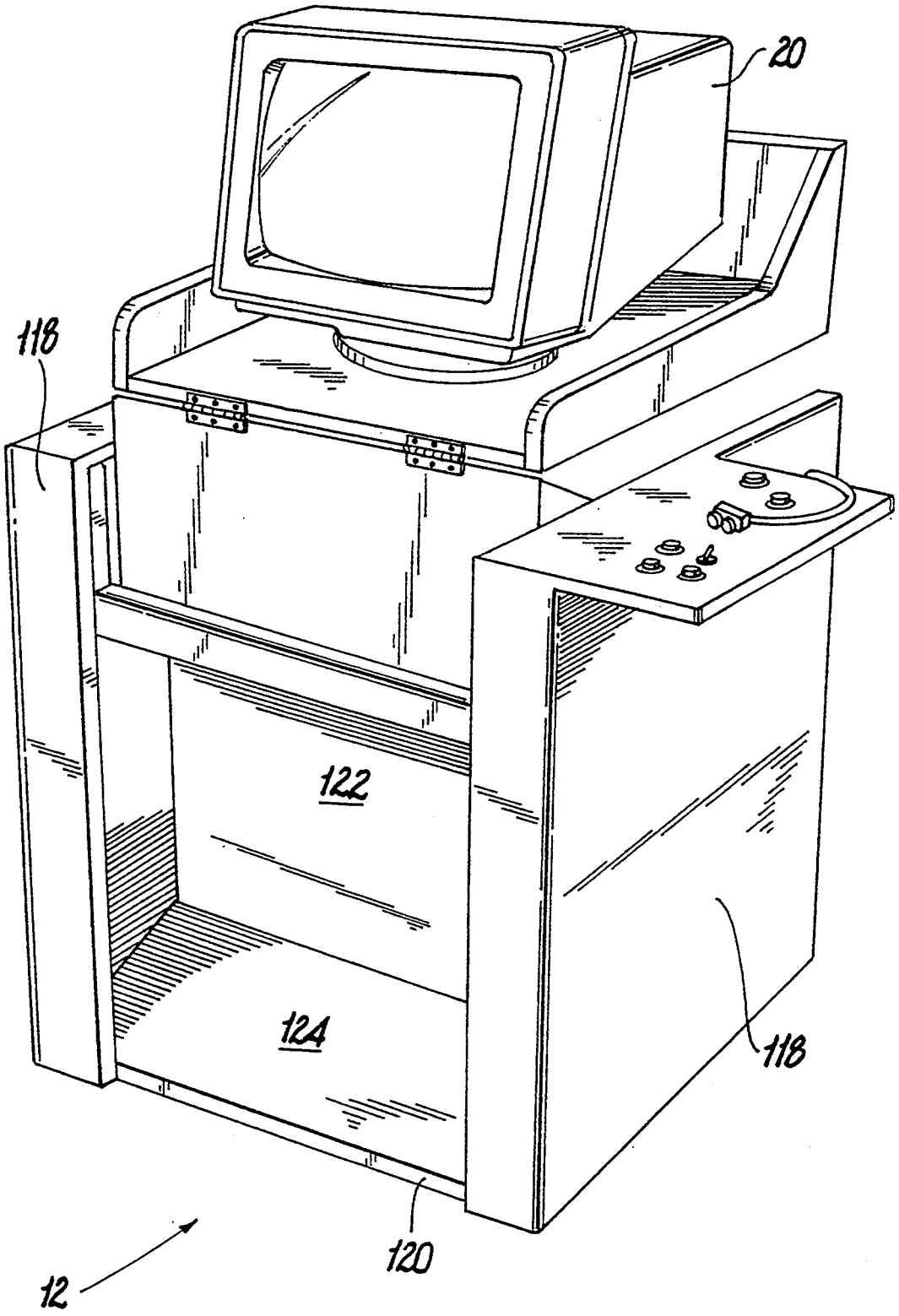
FIG. 8 is a front perspective view of the computer workstation shown in FIG. 1 illustrating a supporting skirt according to a preferred embodiment of the present invention.

As shown in FIG. 8, a decorative and protective supporting skirt 118, formed of wood, metal, plastic or the like, may be mounted around the base assembly 12 and held in place by a series of screws, pins, or other suitable fastener recognized in the art. The supporting skirt 118 includes a platform 120, a rear wall 122 extending upward therefrom and an inclined foot rest 124 extending backward to rear wall 122. The rear wall 122 serves both as a rigid structural member for the workstation 10 and as a barrier between the workstation 10 and the workers feet and hands and that of the moving and electrical parts of the workstation 10. When used with the supporting skirt 118, the workstation 10 becomes an integral computer workstation, having a continuously adjustable VDT 20, adjustable keyboard stand (not shown), foot rest 124, printer stand (not shown) and CPU shelf (not shown).

From the foregoing description it can be seen that the present invention comprises an improved ergonomically adjustable computer workstation. It will be appreciated by those skilled in the art, that changes could be made to the embodiments described in the foregoing description without departing from the broad inventive concept thereof. It is understood, therefore, that this invention is not limited to the particular embodiment disclosed, but is intended to cover all modifications which are in the scope and spirit of the invention as defined by the appended claims.

What is claimed is:

1. A workstation for providing variable vertical and rotational orientation of a video display terminal, said workstation comprising:

a) a fixed base assembly;

b) a movable frame assembly slidably mounted within said fixed base assembly, said movable frame assembly comprising a support member and a platform pivotally coupled to said support member for supporting a video display terminal thereon;

c) means for adjusting the vertical orientation of said movable frame assembly relative to said base assembly comprising a motor mounted to said base assembly for exerting a rotational force; means coupled to said motor for converting said rotational force into a linear force; and linkage means coupled to said converting means for transmitting said linear force to said movable frame assembly comprising two pairs of vertically oriented gear racks symmetrically mounted about the periphery of said base assembly; and two pairs of pinion gears mounted to said frame assembly by a respective shaft, each pair of pinion gears being in meshing contact with a respective pair of said gear racks for vertical movement thereon, whereby said linear force is adapted to be transmitted to said frame assembly to vary the vertical orientation of said frame assembly relative to said base assembly; and d) means mounted to said frame assembly for adjusting the rotational orientation of said platform relative to said support member.

2. The workstation in accordance with claim 1, wherein said motor comprises a rotating shaft defining a worm gear and said converting means comprises a first pulley including a worm wheel in meshing contact with said worm gear, said first pulley being rotatably coupled to a second pulley rotatably coupled to said linkage means, whereby rotation of said rotating shaft by said motor in a first direction causes said worm wheel and thereby said first and second pulleys to rotate in a second direction perpendicular to said first direction to thereby convert said rotational force to said linear force and transmit said linear force to said movable frame assembly.

3. The workstation in accordance with claim 2, wherein said means for adjusting the rotational orientation comprises:

a) a first pivot bracket fixedly attached to said frame assembly at said support member thereof;

b) a second pivot bracket fixedly attached to said platform;

c) a gas cylinder means for exerting a holding force and a driving force in the upward direction, said gas cylinder including a cylinder section and a piston section, one of said cylinder and piston sections being fixedly attached at said support member to said first pivot bracket and the other of said cylinder and piston sections being fixedly attached at said platform to said second pivot bracket; and d) compressor means for selectively providing pressurized air to said gas cylinder means in order to create said holding and driving force.

4. The workstation in accordance with claim 1 further comprising a protective supporting skirt mounted around said base assembly.

5. A workstation for providing variable vertical and tilt orientation of a video display terminal, said workstation comprising:

a) a fixed box-like housing assembly open at its top;

b) a movable, box-like frame assembly telescopically mounted within said housing assembly for movement therethrough, said frame assembly having a platform pivotally hinged along one edge to a front wall of said frame assembly to support a video display terminal thereon;

c) a motor mounted on a side wall of said fixed housing assembly for exerting a rotational force;

d) means coupled to said motor for converting said rotational force into a linear force; and e) cooperative linkage means along opposing sides of said fixed housing assembly and said frame assembly coupled to said converting means for transmitting said linear force to said movable frame assembly to thereby selectively raise and lower the movable frame assembly relative to said fixed housing assembly; and f) motive means mounted to said frame assembly and connected to said platform for selectively pivoting said platform about one edge thereby adjusting the tilt orientation of said video display terminal relative to said frame assembly.

6. The workstation in accordance with claim 5 wherein said motor comprises a rotating shaft defining a worm gear and said converting means comprises a first pulley including a worm wheel in meshing contact with said worm gear, said first pulley being rotatably coupled to a second pulley rotatably coupled to said linkage means, whereby rotation of said rotating shaft by said motor in a first direction causes said worm wheel and thereby said first and second pulleys to rotate in a second direction perpendicular to said first direction to thereby convert said rotational force to said linear force and transmit said linear force to said movable frame assembly.

7. The workstation in accordance with claim 6, wherein said linkage means comprises:

a) two pairs of vertically oriented gear racks symmetrically mounted about the periphery of said fixed housing assembly; and b) two pairs of pinion gears mounted to said frame assembly by a respective shaft, each pair of pinion gears being in meshing contact with a respective pair of said gear racks for vertical movement thereon, whereby said linear force is adapted to be transmitted to said frame assembly to vary the vertical orientation of said frame assembly relative to said fixed housing assembly.

8. The workstation in accordance with claim 5, wherein said motive means for pivoting said platform comprises:

a) a first pivot bracket fixedly attached to the bottom wall of said frame assembly at said supporting member thereof;

b) a second pivot bracket fixedly attached to said platform;

c) a gas cylinder means for exerting a holding force and a driving force in the upward direction, said gas cylinder including a cylinder section and a piston section, one of said cylinder and piston sections being fixedly attached at said supporting member to said first pivot bracket and the other of said cylinder and piston sections being fixedly attached at said platform to said second pivot bracket; and d) compressor means for selectively providing pressurized air to said gas cylinder means in order to create said holding and driving force.

* * * * *